US009820524B1

(12) United States Patent
Whitcomb

(10) Patent No.: US 9,820,524 B1
(45) Date of Patent: Nov. 21, 2017

(54) HELMET HAVING NON-BURSTING AIR CELLS

(71) Applicant: John E. Whitcomb, Elm Grove, WI (US)

(72) Inventor: John E. Whitcomb, Elm Grove, WI (US)

( * ) Notice: Subject to any disclaimer, the term of this patent is extended or adjusted under 35 U.S.C. 154(b) by 347 days.

(21) Appl. No.: 14/588,998

(22) Filed: Jan. 5, 2015

Related U.S. Application Data

(63) Continuation of application No. 14/337,582, filed on Jul. 22, 2014, now abandoned.

(60) Provisional application No. 61/967,291, filed on Mar. 10, 2014, provisional application No. 61/962,916, filed on Nov. 13, 2013.

(51) Int. Cl.

| | |
|---|---|
| ***A42B 3/00*** | (2006.01) |
| ***A42B 3/12*** | (2006.01) |
| ***A63B 71/10*** | (2006.01) |
| ***A63B 71/08*** | (2006.01) |
| ***F41H 1/04*** | (2006.01) |

(52) U.S. Cl.
CPC ..... *A42B 3/122* (2013.01); *A63B 71/081* (2013.01); *A63B 71/10* (2013.01); *F41H 1/04* (2013.01)

(58) Field of Classification Search
CPC ..... A42B 3/003; A42B 3/121; A42B 3/122; A63B 71/081; A63B 71/10
See application file for complete search history.

(56) References Cited

U.S. PATENT DOCUMENTS

| | | | | |
|---|---|---|---|---|
| 3,872,511 | A | 3/1975 | Nichols | |
| 3,999,220 | A | 12/1976 | Keltner | |
| 4,035,846 | A * | 7/1977 | Jencks | A42B 3/122 2/413 |
| 4,586,200 | A | 5/1986 | Poon | |
| 5,129,107 | A | 7/1992 | Lorenzo | |
| 5,263,203 | A | 11/1993 | Kraemer et al. | |
| 5,669,079 | A | 9/1997 | Morgan | |
| 6,709,062 | B2 | 3/2004 | Shah | |
| 8,640,267 | B1 * | 2/2014 | Cohen | A42B 3/063 2/411 |
| 2013/0174329 | A1 * | 7/2013 | Hanson | A42B 3/069 2/411 |

* cited by examiner

*Primary Examiner* — Sally Haden
(74) *Attorney, Agent, or Firm* — Donald J. Ersler

(57) ABSTRACT

A helmet having non-bursting air cells preferably includes a hard helmet shell, an outside air cell impact layer and an inside air cell impact layer. The outside air cell impact layer preferably includes at least one air cell layer and an outside layer of sheet material. Each air cell layer includes a plurality of air cells created between two plastic sheets. The inside air cell impact layer includes the at least one air cell layer. The inside and outside air cell impact layers may be permanently or removably attached to hard helmet shell. A second embodiment of the helmet having non-bursting air cells preferably includes the hard helmet shell, the outside air cell impact layer and an inside air cell inflatable impact layer. The inside air cell inflatable impact layer preferably includes at least one inflatable air cell layer and a check valve.

16 Claims, 10 Drawing Sheets

HELMET HAVING NON-BURSTING AIR CELLS

CROSS-REFERENCES TO RELATED APPLICATIONS

This is a non-provisional application taking priority from patent application Ser. No. 14/337,582 filed on Jul. 22, 2014, which claims the benefit of provisional application No. 61/962,916 filed on Nov. 13, 2013 and provisional application No. 61/967,291 filed On Mar. 10, 2014.

BACKGROUND OF THE INVENTION

1. Field of the Invention

The present invention relates generally to helmets and more specifically to a helmet having non-bursting air cell, which includes at least one air cell impact layer.

2. Discussion of the Prior Art

The purpose of protective helmets is to prevent head injury incurred during some event, such as football, ice hockey, horseback riding, skiing, lacrosse, baseball, riding a motorcycle, construction and military combat. Helmets were first invented for protection in military engagements, and as such, started as protection from hand held weapons and evolved in the $20^{th}$ Century to protect from projectiles and explosives. As such, rigid, impenetrable helmets have been the paradigm we have used for the prevention of head injuries.

Rigid helmets have been partially successful at preventing injuries. However, the recent epidemic of concussions and the increasing awareness of the cumulative problems associated with repeated head trauma have unpacked the limitations of the current structure of protective helmets in all sports. Indeed, the same limitation could be claimed for all protective helmets including construction and military helmets.

The physics of head injury is all focused on the distance over which deceleration occurs. The human brain is very fragile, being composed of cells wrapped in membranes made of fluid fatty acids. Several trillion synapses in the brain are delicately poised in proximity to one another, without rigid and strong connections. These synapses are the functional means by which the brain operates. Shaking them disrupts them. The human nervous system has developed a host of strategies to enshrine the delicate neurons and their even more delicate synapse in a protective cocoon of safety. First and foremost, the brain is floating in water (otherwise called the cerebral spinal fluid), creating a bath without rigid inflexible supports. Within that water, the brain is suspended in a delicate spider web of suspending fibers and membranes that keep water from moving too quickly around the surface and allowing the soft brain to be gently suspended within the bony structure of the skull. The skull provides a rigid structure to contain the floating bath of fluid. Of note, the skull can be cracked and shattered as one strategy of dissipating force. This may lead to survival with subsequent healing. It is a unique and delicate bony structure around the brain, not seen anywhere else in the human body. The scalp provides an additional layer of safety. It is mobile and gives when struck, providing a few extra millimeters of deceleration distance. The scalp uniquely tears when stressed by direct blows, creating yet another mechanism of safety. The tearing creates large and dramatic scalp wounds in direct head trauma, but the brain underneath survives. Finally, the human skull is surrounded by hair, which can provide another layer of cushioning.

What are the physics of deceleration injury? The formula is simple: ΔVelocity/time=Deceleration. The change in velocity is divided by time. Rigid structures striking each other have a spike of deceleration within the first 0.00001 seconds. The more rigid and brittle, the higher the G-force generated for a shorter fragment of time. The Holy Grail of injury prevention in deceleration injury is to increase the distance and therefore time during which deceleration occurs. We are familiar with automobiles and have seen the effectiveness of airbags that increase the distance of deceleration of the human torso before it strikes the steering wheel. Vehicles are also designed to crumple so that force is taken up by bending metal, collapsing frames, shattering fenders, stretching seatbelts all of which increase the distance and time over which the human inside decelerates. Each of these strategies also complements the others to have a net effect of human survival, lowing the G forces from sufficient to break bones to simple sprains, strains and bruises.

Protective helmets have, to date, failed to provide a complete cocoon of safety. If the analogy to the human head can be used, protective helmets provide a skull and the inner dura, but there is no outer layer of safety. There is no scalp. No hair. Some advances have been made with the use of external foam with the SG Helmet. The missing ingredient in foam is that it fails to "fail". The human scalp tears and gives way. Foam doesn't tear. It does provide distance for greater deceleration, resulting in reduction of concussion injuries.

The value of air bubbles is that they easily deform, have little weight, stretch, deform rapidly with increasing resistance and, in extreme circumstances, burst. Bursting is a critical component, as it allows for the dissipation of force and then allows distance to increase as the next layer of bubbles can absorb the evolving contact. However, the essential stretching and increasing air pressure upon contact makes for a gradient of deceleration, which will provide protection. Foam deforms but is not as fluid as air bubbles, has greater weight, which may result in rotational injuries of the neck. The foam cannot burst thereby dissipating energy.

U.S. Pat No. 3,872,511 to Nichols discloses protective headgear. U.S. Pat. No. 3,999,220 to Keltner discloses air cushioned protective gear. U.S. Pat. No. 4,586,200 to Poon discloses a protective crash helmet. U.S. Pat. No. 5,129,107 discloses an inflatable safety helmet specially for motorcycling. U.S. Pat. No. 5,263,203 to Kraemer et al. discloses an integrated pump mechanism and inflatable liner for protective. U.S. Pat. No. 5,669,079 to Morgan discloses a safety enhanced motorcycle helmet. U.S. Pat. No. 6,709,062 to Shah discloses a head restraint for a passenger of a vehicle.

Accordingly, there is a clearly felt need in the art for a helmet having non-bursting air cell, which includes at least one air cell impact layer mounted to an exterior and an interior of a hard shell helmet.

SUMMARY OF THE INVENTION

The present invention provides a soft helmet having blunt force trauma protection, which includes an air bubble impact layer. The soft helmet is suitable for cycling and medical helmet applications. The medical helmet applications include adults with uncontrolled seizure disorder, children who have repetitive head banging behavior, post neurosurgical interventions requiring skull protection or any other brain endangering behavior that requires a protective helmet.

The soft helmet having blunt force trauma protection (soft helmet) includes a base shell member, at least one air bubble impact layer and a removable retention strap. The base shell member is shaped or formed to fit on a top of a human head. The base shell member is preferably fabricated from a flexible sheet of synthetic fiber material, such as Kevlar, but other materials may also be used. The inner and outer air bubble impact layers include a plurality of air filled bubbles, which do not burst upon impact. The plurality of bubbles are created between two flexible sheets of material. Each bubble retains the air therein and does not pass it to an adjacent bubble. Each bubble preferably includes a substantially elliptical shape in a horizontal plane and a substantially half elliptical shape in a vertical plane for increasing aerodynamics. The at least one air bubble impact layer is permanently attached to the base shell member with adhesive or any other suitable substance or method. Ventilation openings are preferably formed between adjacent bubbles and through the at least one impact layer and the base member. The removable retention strap is preferably secured to opposing sides of a bottom of the base shell member with sewing or any other suitable method. Retention straps are well known in the art and need not be explained in detail.

A second embodiment of a soft helmet includes the base shell member, at least two air bubble impact layers and a removable retention strap. The base shell member is shaped or formed to fit on a top of a human head. The at least one air bubble impact layer includes a plurality of small air filled bubbles, which do not burst upon impact. The plurality of bubbles are created between two flexible sheets of material. Each small bubble retains the air therein and does not pass it to an adjacent bubble. Each small bubble preferably includes a substantially round shape in a horizontal plane. A first air bubble impact layer is permanently attached to the base shell member with adhesive or any other suitable substance or method. A second air bubble impact layer is permanently attached to a top of the first air bubble impact layer with adhesive or any other suitable method. Ventilation openings are preferably formed between adjacent bubbles and through the at least two air bubble impact layers and the base member. The removable retention strap is preferably secured to opposing sides of the bottom of the base shell member with sewing or any other suitable method.

A helmet having non-bursting air cells preferably includes a hard helmet shell, an inside air cell impact layer and an outside air cell impact layer. The air cells in the inside and outside air cell impact layers do not burst upon impact. The hard helmet shell is may be any type of prior art helmet, such as a football helmet, a motorcycle helmet, a bicycle helmet, a baseball helmet, lacrosse helmet or any type of protective helmet for a human head. The outside air cell impact layer preferably includes at least one air cell layer and an outside layer of sheet material. Each air cell layer includes a plurality of air cells created between two plastic sheets. Air is not transferred between the plurality of air cells. The plurality of cells preferably have a hexagon shape, but other shapes may also be used, such as round or square. The inside air cell impact layer includes the at least one air cell layer. The outside air cell impact layer may be permanently or removably attached to an outside surface of the hard helmet shell. The inside air cell impact layer may be permanently or removably attached to an inside surface of the hard helmet shell.

A second embodiment of the helmet having non-bursting air cells preferably includes a hard helmet shell, an inside air cell inflatable layer and an outside air cell impact layer. The air cells in the inside air cell inflatable layer and the outside air cell impact layer do not burst upon impact. The hard helmet shell is from any type of prior art helmet as previously discussed. The outside air cell impact layer preferably includes the at least one air cell layer and the outside layer of sheet material. The outside air cell impact layer may be permanently or removably attached to an outside surface of the hard helmet shell. The inside air cell inflatable impact layer preferably includes at least one inflatable air cell layer and a check valve. Each inflatable air cell layer includes a plurality of cells created between two flexible sheets of material. A plurality of air passages are created between adjacent air cells in at least one direction. An air fill manifold system is also created to supply a row or column of air cells with pressurized air. The plurality of air passages and the air fill manifold are created between the two sheets flexible sheets of material. A check valve is attached to an entrance of the manifold. The check valve does not allow pressurized air from escaping the plurality of air cells. A fill nozzle of the check valve is filled to a predetermined air pressure reading. The inside air cell impact layer may be permanently or removably attached to an inside surface of the hard helmet shell. The fill nozzle of the check valve preferably extends past an outside surface of the helmet.

Accordingly, it is an object of the present invention to provide a soft helmet, which includes at least one air bubble impact layer having a plurality of elliptical bubbles mounted to a flexible base member.

It is another object of the present invention to provide a soft helmet, which includes at least two air bubble impact layer having a plurality of small bubbles mounted to a flexible base member.

It is a further object of the present invention to provide a soft helmet, which includes an air bubble impact layer disposed on an outside surface of the helmet.

It is yet a further object of the present invention to provide a helmet having non-bursting air cells, which includes inside and outside air cell impact layers located on inside and outside surface of a hard helmet shell.

Finally, it is an object of the present invention to provide a helmet having non-bursting air cells, which includes an inside air cell inflatable impact layer and an outside air cell impact layer located on inside and outside surfaces of the helmet.

These and additional objects, advantages, features and benefits of the present invention will become apparent from the following specification.

DETAILED DESCRIPTION OF THE PREFERRED EMBODIMENTS

Figure 1:
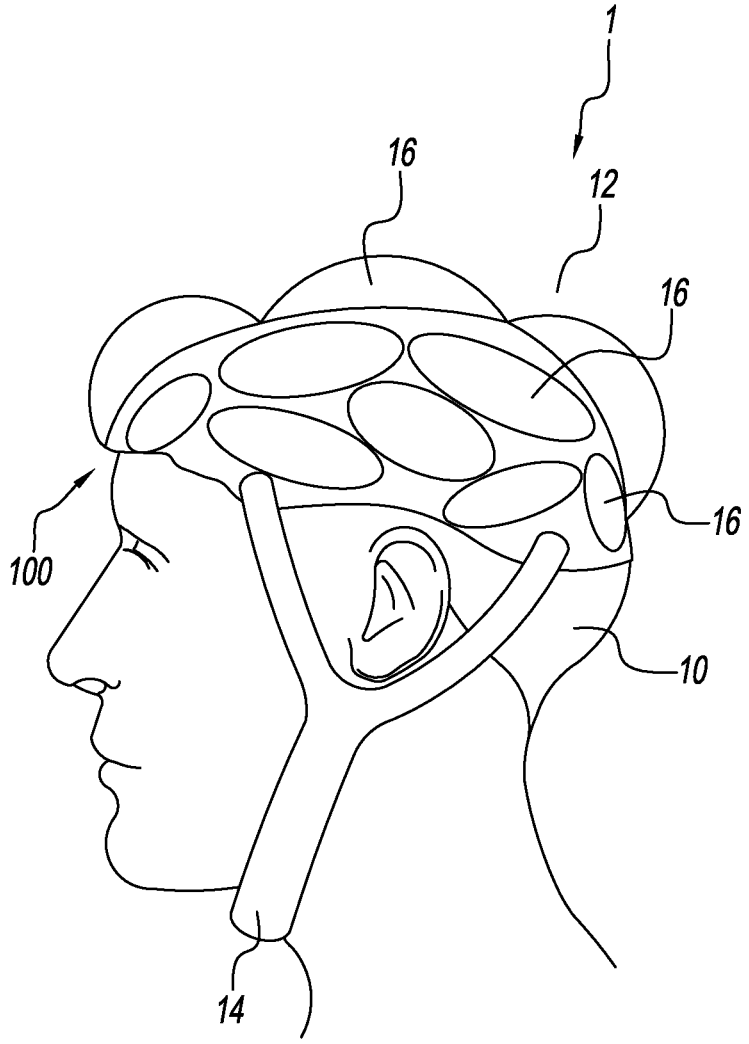
FIG. 1 is a side view of a user wearing a soft helmet in accordance with the present invention.
Figure 2:
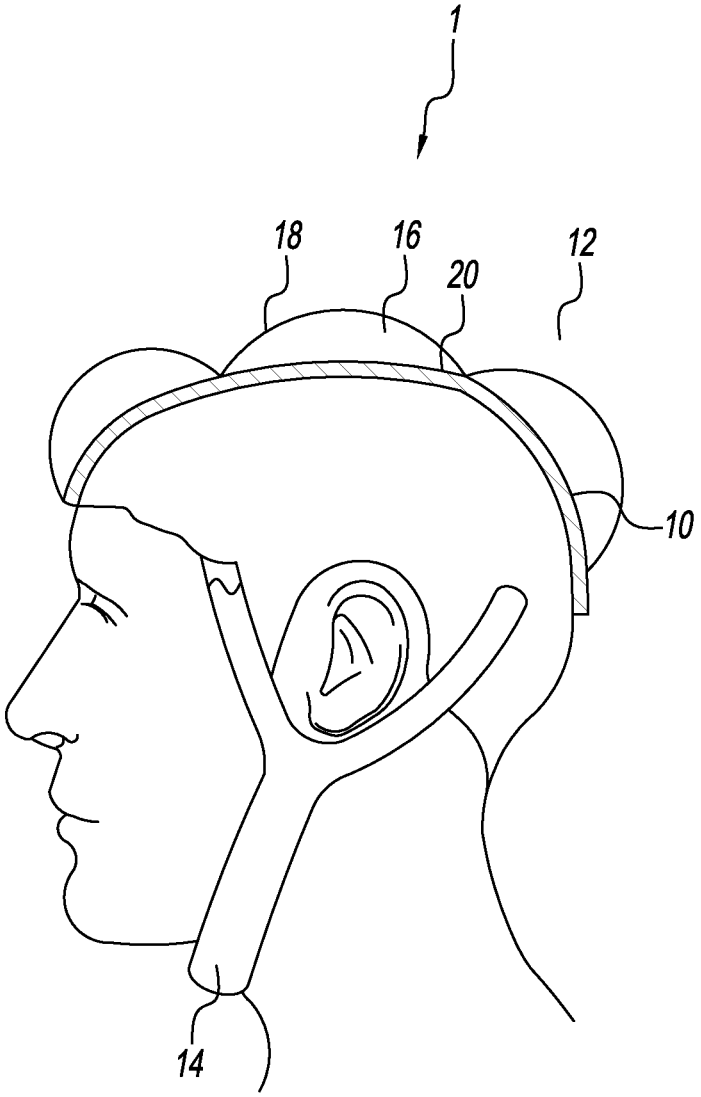
FIG. 2 is a side cross sectional view of a user wearing a soft helmet in accordance with the present invention.

With reference now to the drawings, and particularly to FIG. 1, there is shown a side view of a user wearing a soft helmet 1. The soft helmet 1 includes a base shell member 10, at least one air bubble impact layer 12 and a retention strap 14. The base shell member 10 is shaped or formed to fit on a top of a human head 100. The base shell member 10 is fabricated from a flexible sheet of synthetic fiber material, such as Kevlar. The at least one air bubble impact layer 12 includes a plurality of air filled bubbles 16, which do not burst upon impact. The plurality of bubbles 16 are created between two flexible sheets of material 18, 20. Each bubble 16 retains the air therein and does not pass it to an adjacent bubble 16. Each bubble 16 preferably includes a substantially elliptical shape in a horizontal plane and a substantially half elliptical shape in a vertical plane for increasing aerodynamics.

Figure 3:
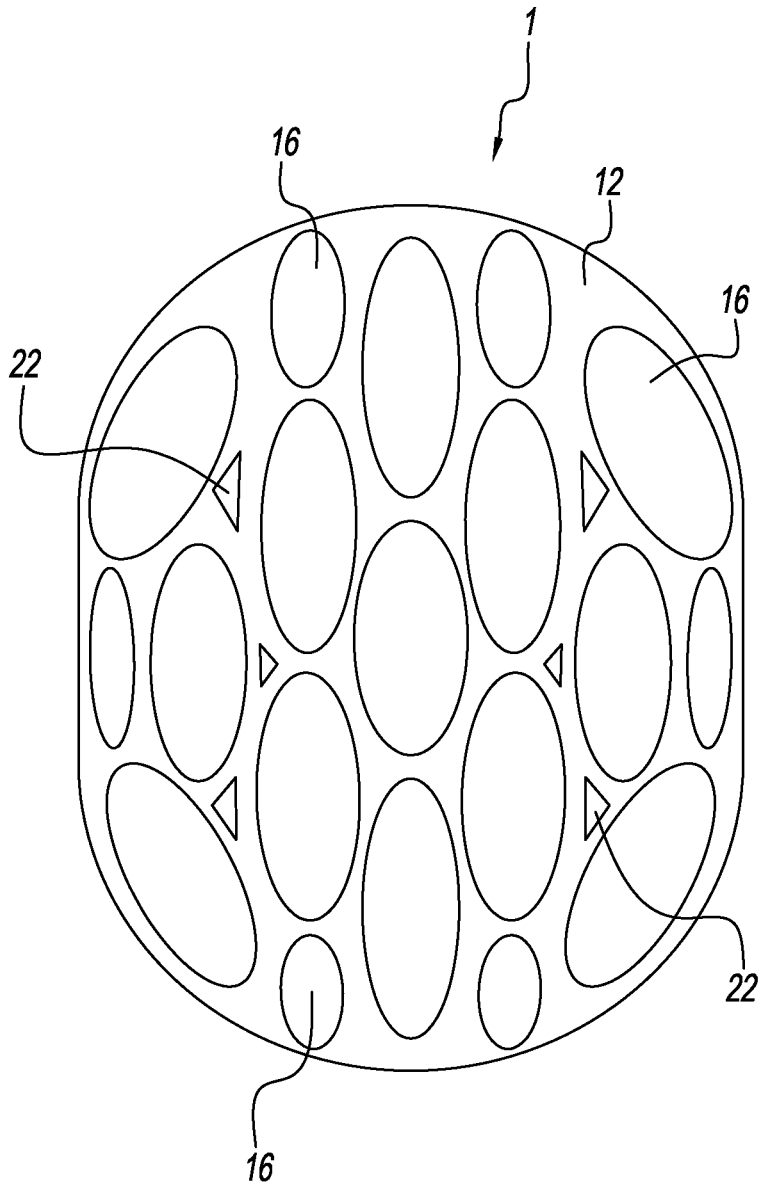
FIG. 3 is a top view of a soft helmet in accordance with the present invention.
Figure 4:
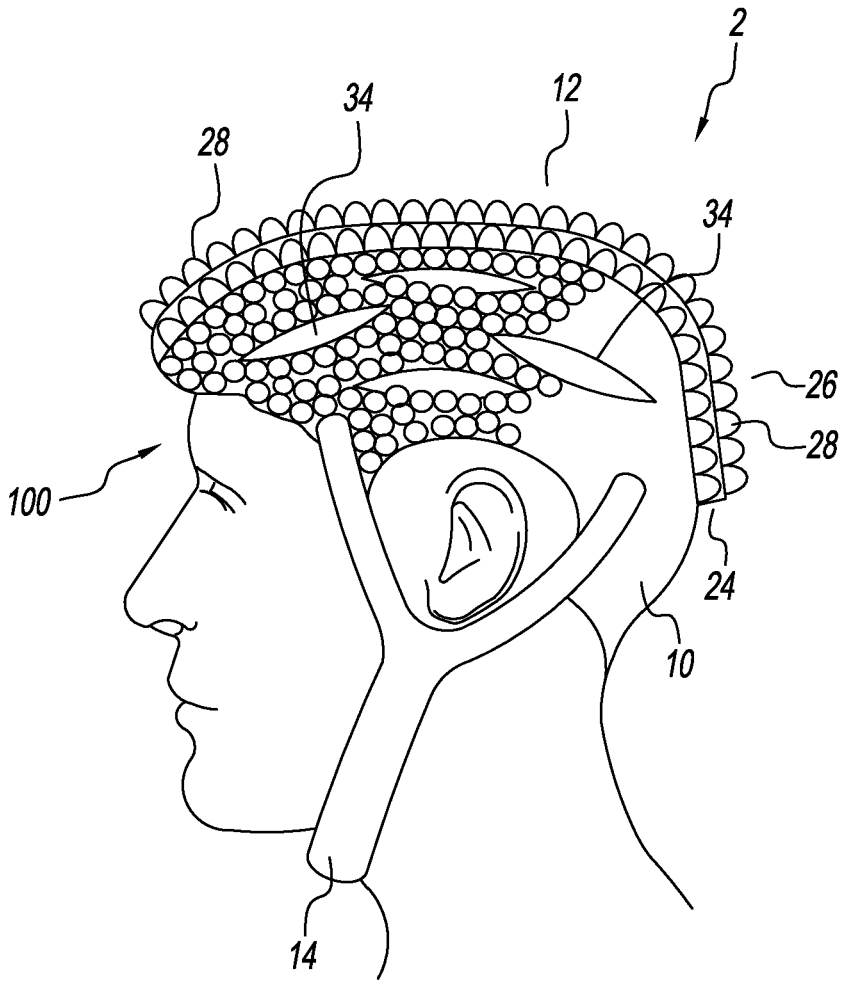
FIG. 4 is a side view of a second embodiment of a soft helmet in accordance with the present invention.
Figure 5:
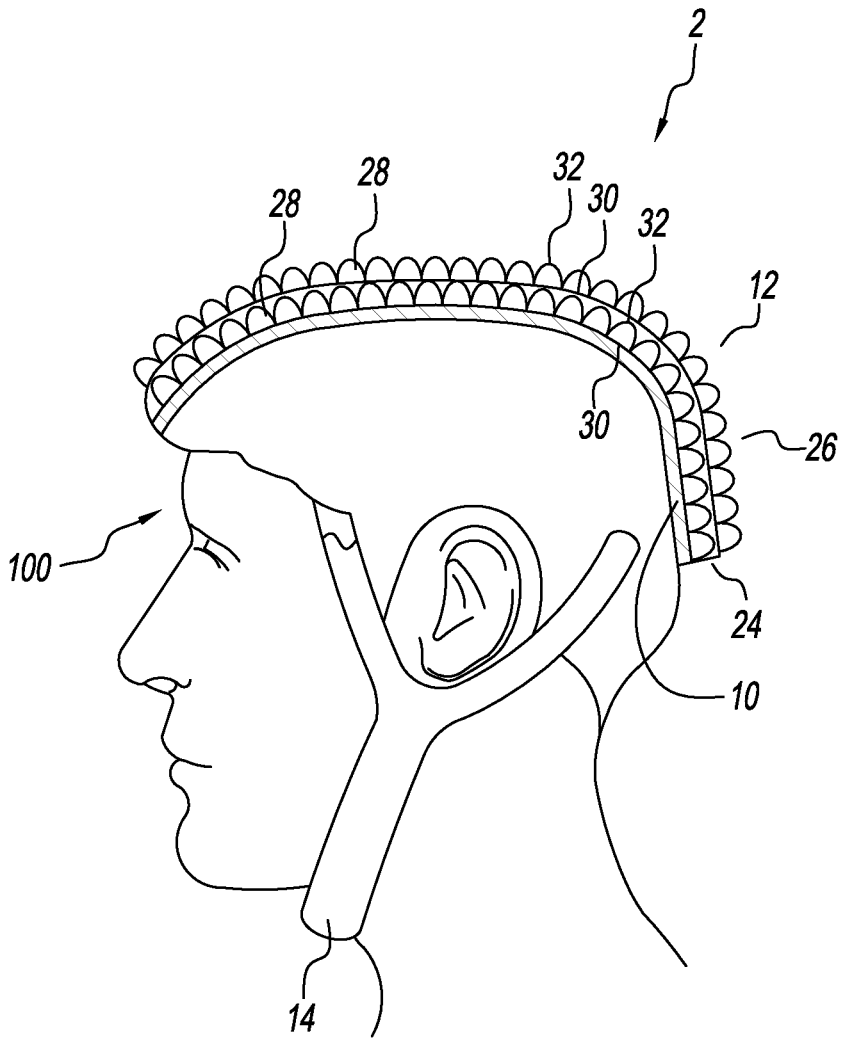
FIG. 5 is a side cross sectional view of a second embodiment of a soft helmet in accordance with the present invention.
Figure 6:
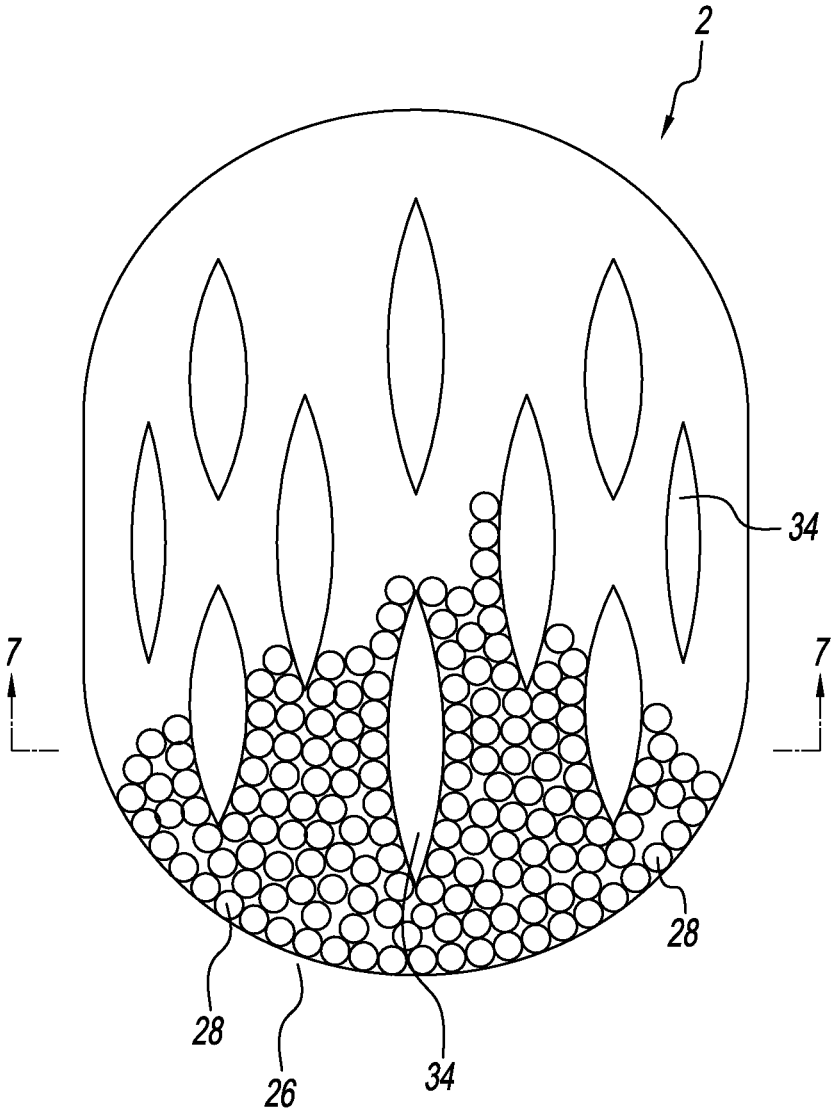
FIG. 6 is a top view of a second embodiment of a soft helmet in accordance with the present
Figure 7:
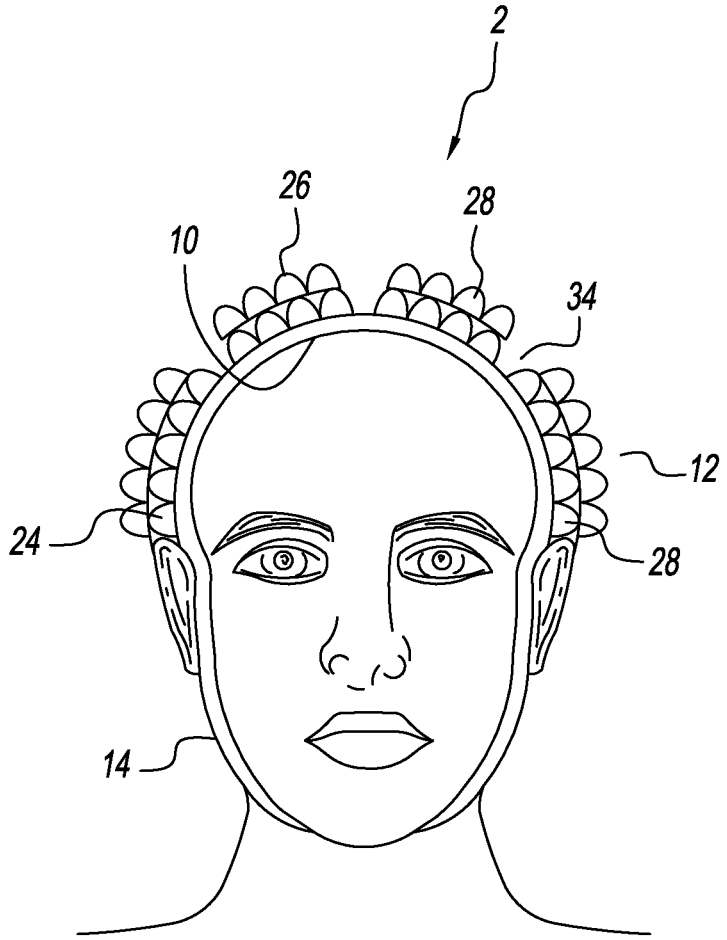
FIG. 7 is a front cross sectional view cut through FIG. 6 of a second embodiment of a soft helmet in accordance with the present.

The plurality of bubbles 16 may be different sizes to optimize nesting of the bubbles 16 on the impact layer 12. The at least one air bubble impact layer 12 is permanently attached to the base shell member 10 with adhesive or any other suitable substance or method. With reference to FIG. 3, ventilation openings 22 are preferably formed through the impact layer 12 and the base shell member 10. The retention strap 14 is preferably secured to opposing sides of a bottom of the base shell member 10 with sewing or any other suitable method. Retention straps are well known in the art and need not be explained in detail.

A second embodiment of a soft helmet 2 includes the base shell member 10, at least two air bubble impact layers 24, 26 and the removable retention strap 14. The base shell member 10 is shaped or formed to fit on the top of the human head 100. The at least two air bubble impact layers 24, 26 include a plurality of small air filled bubbles 28, which do not burst upon impact. The plurality of small bubbles 28 are created between two flexible sheets of material 30, 32. Each small bubble 28 retains the air therein and does not pass it to an adjacent bubble 28. Each small bubble 28 preferably includes a substantially round shape in a horizontal plane. The soft helmet 2 is suitable for cycling. The first impact layer 24 is permanently attached to the base shell member 10 with adhesive or any other suitable substance or method. The second impact layer 26 is permanently attached to a top of the first impact layer 24 with adhesive or any other suitable method. Ventilation openings 34 are preferably formed through the at least two impact layers 24, 26 and the base member 10. The removable retention strap 14 is preferably secured to opposing sides of the bottom of the base shell member 10 with sewing or any other suitable method.

Figure 8:
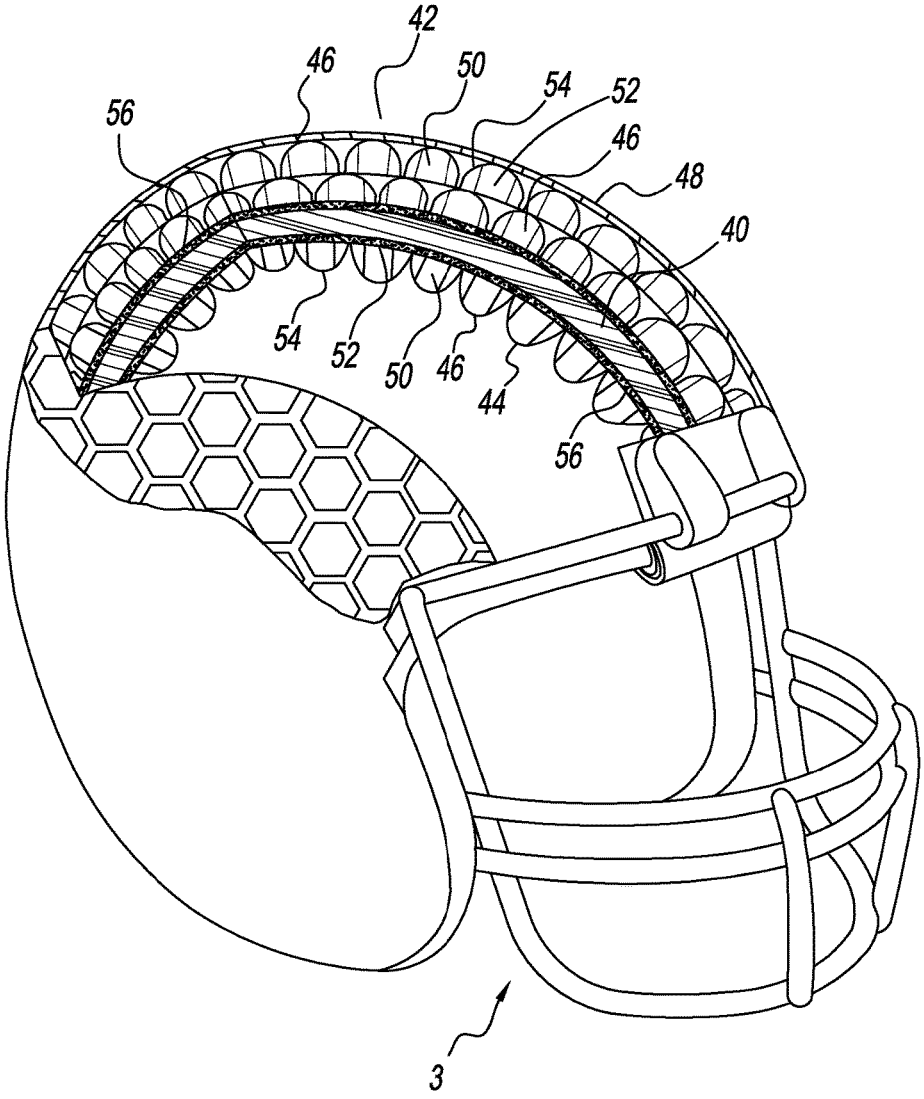
FIG. 8 is a perspective cut-away view of a helmet having non-bursting air cells with inside and outside air cell impact layers in accordance with the present invention.

With reference to FIG. 8, a helmet having non-bursting air cells 3 preferably includes a hard helmet shell 40, an outside air cell impact layer 42 and an inside air cell impact layer 44. The air cells 50 in the inside and outside air cell impact layers do not burst upon impact. The hard helmet shell 40 is any type of prior art helmet, such as a football helmet, a motorcycle helmet, a bicycle helmet, a baseball helmet, lacrosse helmet or any type of protective helmet for a human head. The outside air cell impact layer 42 preferably includes at least one air cell layer 46 and an outside layer of sheet material 48. Team identification may be printed on the outside layer of sheet material 48. The at least one air cell layer 46 includes a plurality of air cells 50 created by a base sheet 52 and a cell sheet 54. Air is not transferred between the plurality of air cells 50. The plurality of air cells 50 preferably have a hexagon shape, but other shapes may also be used, such as round or square.

The at least one air cell layer 46 may be permanently attached to an outside surface of the hard helmet shell 40 or removably attached with a removable attachment system 56. The removable attachment system 56 is preferably hook and loop fastening pads, but other suitable removable attachment systems may also be used. A second air cell layer 46 may be attached to a top of the air cell layer 46 with adhesive or any other suitable method. The outside layer of sheet material 48 is permanently attached to a top of the air cell layer 46 or the second air cell layer 46 with adhesive or any other suitable method. The inside air cell impact layer 44 includes the at least one air cell layer 46. The at least one air cell layer 46 may be permanently attached to an inside surface of the hard helmet shell 40 or removably attached with the removable attachment system 56.

Figure 9:
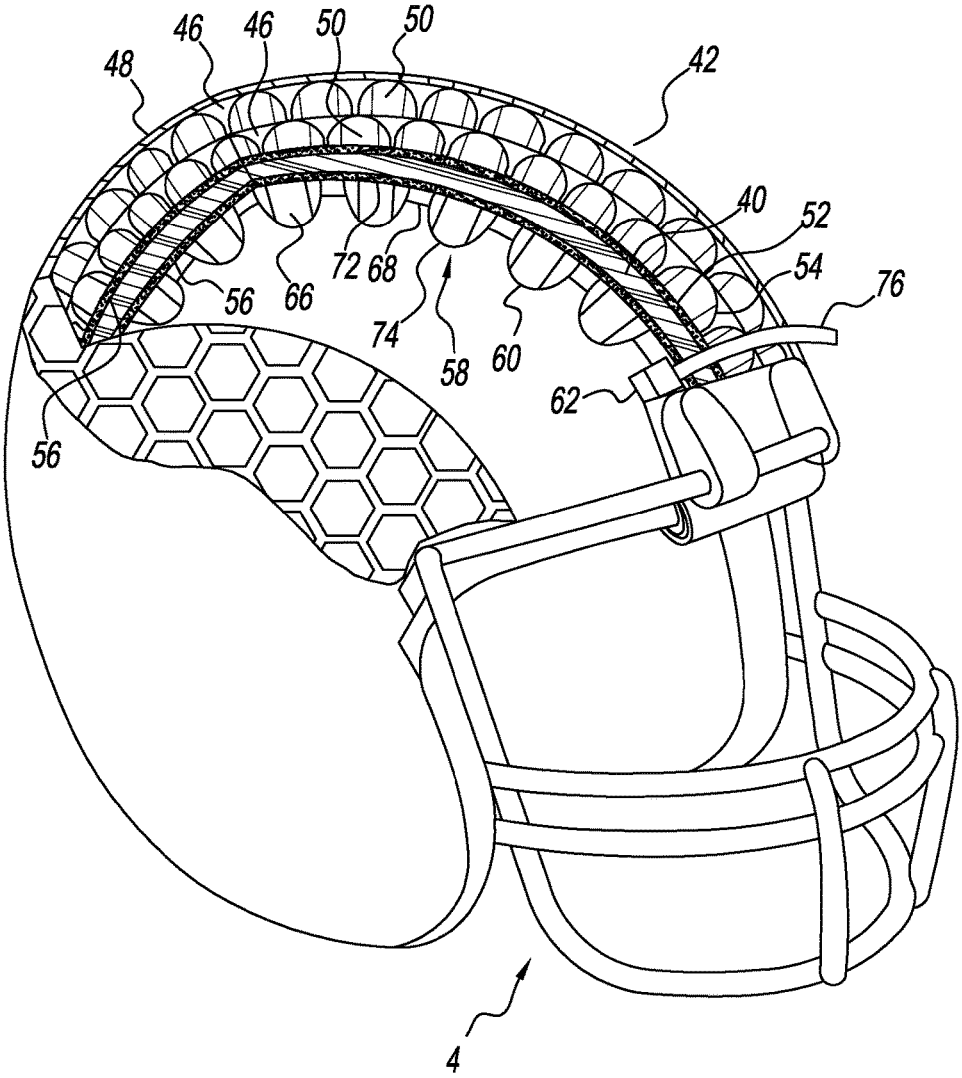
FIG. 9 is a perspective cut-away view of a helmet having non-bursting air cells with an inside air cell inflatable layer and an outside air cell impact layer in accordance with the present invention.

With reference to FIG. 9, a second embodiment of the helmet having non-bursting air cells 4 preferably includes the hard helmet shell 40, the outside air cell impact layer 42 an inside air cell inflatable impact layer 58. The air cells 50 in the inside and outside air cell impact layers do not burst upon impact. The outside air cell impact layer 42 preferably includes the at least one air cell layer 46 and the outside layer of sheet material 48. The outside air cell impact layer 42 may be permanently or removably attached to an outside surface of the hard helmet shell as previously described.

Figure 10:
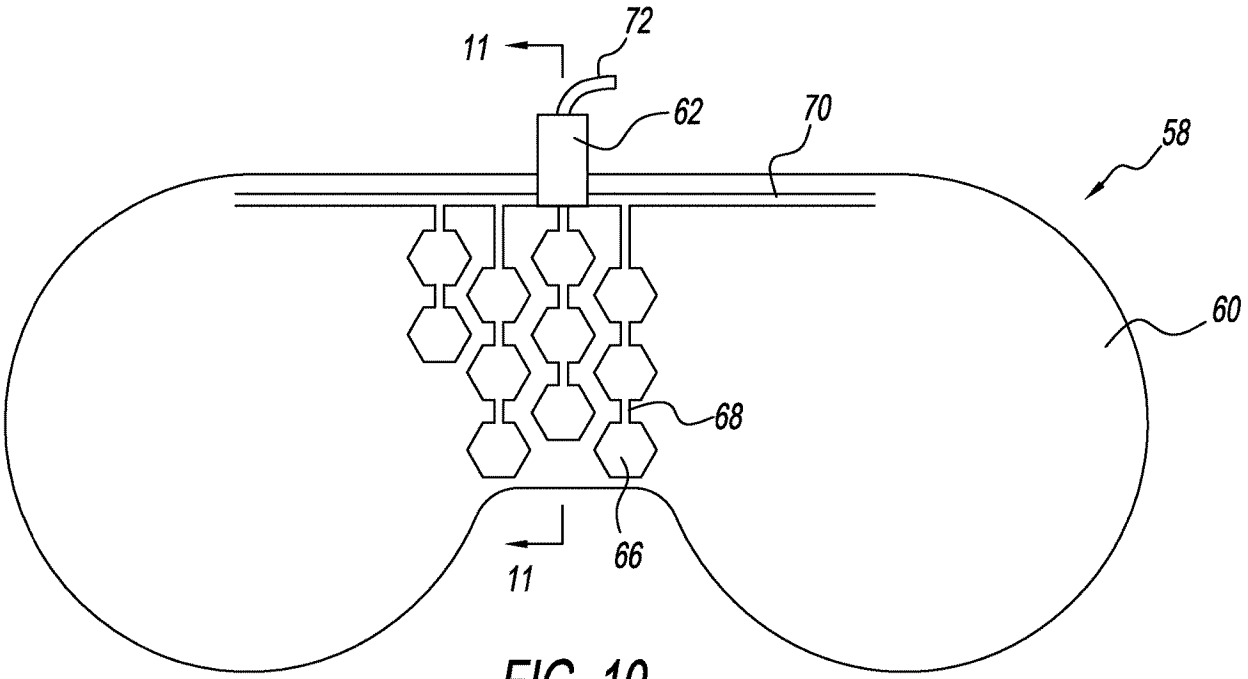
FIG. 10 is a top view of an inside air cell inflatable layer of a helmet having non-bursting air cells in accordance with the present invention.
Figure 11:
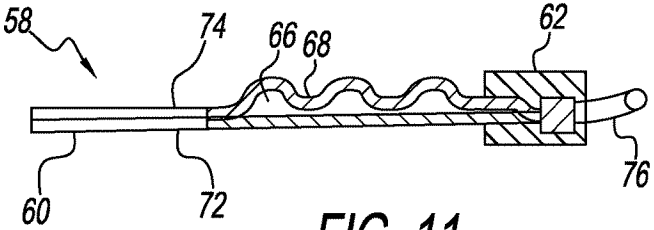
FIG. 11 is a cross sectional view of an inside air cell inflatable layer of a helmet having non-bursting air cells in accordance with the present invention.

With reference to FIGS. 10-11, the inside air cell inflatable layer 58 preferably includes at least one inflatable air cell layer 60 and a check valve 62. The outer perimeter of the inflatable air cell layer 60 is shaped to fit inside the hard helmet shell 40. A plurality of air cells 66, a plurality of air passages 68 and an air manifold 70 are preferably formed between a base sheet 72 and a cell sheet 74. Pressurized air flows into an entrance of the check valve 62 through the fill nozzle 76. The pressured air flows into the air fill manifold 70 through the check valve 62. The air fill manifold 70 distributes the pressurized air to the plurality of air passages 68 and the plurality of air cells 66. The inside air cell inflatable layer 58 may be permanently or removably attached to an inside surface of the hard helmet shell 40. The fill nozzle 76 of the check valve preferably extends past an outside surface of the helmet 40. Air pressure may be measured with an air pressure gage.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A helmet having non-bursting air cells comprising:

a helmet having a hard outer shell, said hard outer shell having an inside surface and an outside surface;

at least one outside air cell layer includes an outside base sheet and an outside air cell sheet, a plurality of outside air cells are created by joining said outside air cell sheet to said outside base sheet, said plurality of outside air cells do not burst upon impact, said at least one outside air cell layer is retained on an outside surface of said hard outer shell; and at least one inside air cell layer includes an inside base sheet and an inside air cell sheet, a plurality of inside air cells are created by joining said inside air cell sheet to said inside base sheet, said plurality of inside air cells do not burst upon impact, said at least one inside air cell layer is retained in an inside surface of said hard outer shell.

2. The helmet having non-bursting air cells of claim 1, further comprising:

an outer layer of sheet material is attached to said at least one outside air cell layer.

3. The helmet having non-bursting air cells of claim 1 wherein:

said plurality of outside and inside air cells having a shape of at least one of hexagon and round.

4. The helmet having non-bursting air cells of claim 1 wherein:

said helmet is one of a football helmet, a motorcycle helmet, a bicycle helmet, a baseball helmet, a lacrosse helmet, an ice hockey helmet, a horseback riding helmet, a skiing helmet, a lacrosse helmet, a construction and military combat helmet.

5. A helmet having non-bursting air cells comprising:

a helmet having a hard outer shell, said hard outer shell having an inside surface and an outside surface;

at least one outside air cell layer includes an outside base sheet and an outside air cell sheet, a plurality of outside air cells are created by joining said outside air cell sheet to said outside base sheet, said plurality of outside air cells do not burst upon impact, said at least one outside air cell layer is retained on an outside surface of said hard outer shell; and an inside air cell inflatable layer includes at least one inflatable air cell layer and a check valve, each inflatable air cell layer includes an inflatable base sheet and an inflatable air cell sheet, a plurality of inflatable air cells and plurality of air passages are created by joining said inflatable air cell sheet to said inflatable base sheet, said inside air cell inflatable layer is retained on an inside surface of said hard outer shell, wherein flowing air through said check valve into said plurality of inflatable air cells through said plurality of air passages to create a plurality of pressurized air cells.

6. The helmet having non-bursting air cells of claim 5, further comprising:

an outer layer of sheet material is attached to said at least one outside air cell layer.

7. The helmet having non-bursting air cells of claim 5 wherein:

said plurality of outside and inside air cells having a shape of at least one of hexagon and round.

8. The helmet having non-bursting air cells of claim 5 wherein:

said helmet is one of a football helmet, a motorcycle helmet, a bicycle helmet, a baseball helmet, a lacrosse helmet, an ice hockey helmet, a horseback riding helmet, a skiing helmet, a lacrosse helmet, a construction and military combat helmet.

9. The helmet having non-bursting air cells of claim 5, further comprising:

a fill nozzle extends from an entrance of said check valve.

10. The helmet having non-bursting air cells of claim 9 wherein:

said fill nozzle extends past said outside surface of said hard outer shell.

11. A helmet having non-bursting air cells comprising:

a helmet having a hard outer shell, said hard outer shell having an inside surface and an outside surface;

at least one outside air cell layer includes an outside base sheet and an outside air cell sheet, a plurality of outside air cells are created by joining said outside air cell sheet to said outside base sheet, said plurality of outside air cells do not burst upon impact, said at least one outside air cell layer is retained on an outside surface of said hard outer shell; and an inside air cell inflatable layer includes at least one inflatable air cell layer and a check valve, each inflatable air cell layer includes an inflatable base sheet and an inflatable air cell sheet, a plurality of inflatable air cells, plurality of air passages and an air manifold are created by joining said inflatable air cell sheet to said inflatable base sheet, said plurality of inflatable air cells are connected to each other with said plurality of air passages, said manifold is connected to said plurality of air cells, said inside air cell inflatable layer is retained on an inside surface of said hard outer shell, wherein flowing air through said check valve into said plurality of inflatable air cells to create a plurality of pressurized air cells.

12. The helmet having non-bursting air cells of claim 11, further comprising:

an outer layer of sheet material is attached to said at least one outside air cell layer.

13. The helmet having non-bursting air cells of claim 11 wherein:

said plurality of outside and inside air cells having a shape of at least one of hexagon round.

14. The helmet having non-bursting air cells of claim 11 wherein:

said helmet is one of a football helmet, a motorcycle helmet, a bicycle helmet, a baseball helmet, a lacrosse helmet, an ice hockey helmet, a horseback riding helmet, a skiing helmet, a lacrosse helmet, a construction and military combat helmet.

15. The helmet having non-bursting air cells of claim 11, further comprising:

a fill nozzle extends from an entrance of said check valve.

16. The helmet having non-bursting air cells of claim 15 wherein:

said fill nozzle extends past said outside surface of said hard outer shell.

* * * * *